US008076848B2

(12) United States Patent
Corazza et al.

(10) Patent No.: US 8,076,848 B2
(45) Date of Patent: Dec. 13, 2011

(54) MERCURY DISPENSING SYSTEM FOR FLUORESCENT LAMPS

(75) Inventors: Alessio Corazza, Camnago Volta (IT); Stefano Paolo Giorgi, Biassono (IT)

(73) Assignee: SAES Getters S.p.A., Lainate (IT)

( * ) Notice: Subject to any disclaimer, the term of this patent is extended or adjusted under 35 U.S.C. 154(b) by 0 days.

(21) Appl. No.: 13/063,930

(22) PCT Filed: Dec. 1, 2009

(86) PCT No.: PCT/EP2009/066171
§ 371 (c)(1),
(2), (4) Date: Mar. 14, 2011

(87) PCT Pub. No.: WO2010/066611
PCT Pub. Date: Jun. 17, 2010

(65) Prior Publication Data

US 2011/0163658 A1 Jul. 7, 2011

(30) Foreign Application Priority Data

Dec. 11, 2008 (IT) ..... M12008A2187

(51) Int. Cl.
*H01J 61/24* (2006.01)
*H01J 7/20* (2006.01)

(52) U.S. Cl. ..... 313/546; 313/564; 313/565; 313/552; 313/547

(58) Field of Classification Search ..... None
See application file for complete search history.

(56) References Cited

U.S. PATENT DOCUMENTS

| | | | | |
|---|---|---|---|---|
| 3,203,901 | A | 8/1965 | Porta | 252/181.6 |
| 3,657,589 | A | 4/1972 | Porta et al. | 313/178 |
| 4,056,750 | A | 11/1977 | Latassa | 313/177 |
| 4,464,133 | A * | 8/1984 | Buhrer | 445/9 |
| 5,686,788 | A | 11/1997 | Lauter | 313/490 |
| 6,043,603 | A | 3/2000 | Weinhardt | 313/566 |
| 6,456,004 | B1 * | 9/2002 | Johnson et al. | 313/552 |
| 6,680,571 | B1 * | 1/2004 | Giorgi et al. | 313/565 |
| 7,674,428 | B2 * | 3/2010 | Coda et al. | 420/587 |
| 2009/0021173 | A1 | 1/2009 | Harzig et al. | 313/639 |

FOREIGN PATENT DOCUMENTS

| | | |
|---|---|---|
| EP | 0161725 | 11/1985 |
| EP | 0581160 | 2/1994 |
| EP | 0669639 | 8/1995 |
| EP | 0691670 | 1/1996 |

(Continued)

OTHER PUBLICATIONS

PCT International Search Report for PCT/EP2009/066171 filed Dec. 1, 2009 in the name of SAES GETTERS S.P.A.

(Continued)

*Primary Examiner* — Sokha Roy

(74) *Attorney, Agent, or Firm* — Steinfl & Bruno LLP

(57) ABSTRACT

The present invention relates to a mercury dispensing system (11; 21, 31) for fluorescent lamps, comprising a dispensing member (12; 22, 32) containing a mercury releasing compound. The dispensing member (12; 22, 32) is fixed on a metal support (13; 23; 33) suitable to be heated by electromagnetic induction in order to cause the activation of said mercury releasing compound. The surface area of the metal support (13; 23; 33) is comprised between 9 and 64 $mm^2$. The invention also relates to fluorescent lamps comprising said mercury dispensing system (11; 21; 31).

19 Claims, 3 Drawing Sheets

FOREIGN PATENT DOCUMENTS

| | | |
|---|---|---|
| EP | 0737995 | 10/1996 |
| EP | 2017876 | 1/2009 |
| GB | 799291 | 8/1958 |
| GB | 2056490 | 3/1981 |
| WO | 98/53479 | 11/1998 |
| WO | 2006/008771 | 1/2006 |
| WO | 2008/007404 | 1/2008 |

OTHER PUBLICATIONS

PCT Written Opinion for PCT/EP2009/066171 filed Dec. 1, 2009 in the name of SAES GETTERS S.P.A.

* cited by examiner

MERCURY DISPENSING SYSTEM FOR FLUORESCENT LAMPS

CROSS REFERENCE TO RELATED APPLICATIONS

The present application is the US national stage of International Application PCT/EP2009/066171 filed on Dec. 1, 2009 which, in turn, claims priority to Italian Patent Application MI2008A002187 filed on Dec. 11, 2008.

The present invention relates to a mercury dispensing system for fluorescent lamps and to fluorescent lamps comprising this dispensing system.

Fluorescent lamps generally comprise glass tubulations, e.g. having a linear or circular shape, containing one or more rare gases, usually argon or neon, and some milligrams of mercury. Two electrodes are present inside the lamp, also called cathodes, which trigger and maintain an electric discharge within the gaseous atmosphere of the lamp causing the luminous emission. The electrodes are in the form of metal filaments arranged at the ends of the tubulation. The electrodes are preferably laterally shielded by means of shielding members that are coaxially arranged with respect to the lamp. The shielding members block the cathode material that is vaporized during the operation of the lamp, thus preventing its deposition onto the glass walls, which is undesired because it would cause localized blackenings and a reduction in the luminous emission.

The dosage of mercury in fluorescent lamps must be as precise and reproducible as possible. In fact, there is a minimum amount of mercury below which a fluorescent lamp does not operate properly but, on the other side, mercury amounts too much larger than the needed minimum amount are not allowed because of the mercury toxicity. This in fact would lead to environmental problems in the case of breaking the lamp and during the disposal phase of the lamp at the end of its working life. Moreover the international standards in the field of fluorescent lamps require lower and lower mercury amounts, still relating to environmental problems. A higher degree of control of the amount of mercury in the lamps (with a minimized standard deviation) and a higher precision in its dosage are therefore required by the lamps producers. Some lamps of the latest generation require a minimum amount of mercury of about 2±0.1 mg, as for example those known in the field as "T5" having a diameter of about 1.6 cm.

During the manufacturing of fluorescent lamps, the mercury dispensing systems are usually based on compounds able to release mercury at high temperatures, typically in the order of 800-900° C., which at the same time ensure a negligible or null mercury release at temperatures lower than 400° C. This property allows to avoid mercury release and undesired pollutions of the lamps during intermediate manufacturing steps. Among the various types of mercury releasing compounds having this property, the most commonly used are $Ti_xZr_yHg_z$ compounds, wherein x and y vary between 0 and 13 with the condition that their sum is comprised between 3 and 13 and z is 1 or 2, as described in U.S. Pat. No. 3,657,589. The use of $Ti_3Hg$ is particularly preferred.

These compounds may also be used in combination with promoters that maximize the mercury release. These promoters are formed of copper together with at least a second element chosen among tin, indium and silver, as described in patent EP 0669639, formed of copper and silicon, as described in patent EP 0691670, or formed of copper, tin and rare earths, as described in patent EP 0737995, all in the applicant's name.

Alternatively, titanium-copper-mercury ternary compounds, such as those described in patent GB 2056490, in the applicant's name, or quaternary mercury releasing compounds having a weight percentage of titanium comprised between 10 and 42%, copper comprised between 14 and 50%, mercury comprised between 20 and 50% and a weight percentage comprised between 1 and 20% of one or more elements among tin, chromium and silicon may be used, as described in the international patent application published as WO 2006/008771, in the applicant's name.

It is known that mercury dispensing systems for fluorescent lamps may advantageously comprise a getter material able to sorb harmful gases. Undesired gaseous chemical species may be present in the lamp as a consequence of its manufacturing process and they might be generated during its operation. Therefore, the use of getter materials allows to extend the working life of the lamp and to maintain its performance substantially constant over time.

Mercury dispensing systems require an activation process of the mercury releasing compound, which typically occurs by electromagnetic induction and is carried out during the manufacturing of the lamps. Due to the reduced size of the mercury dispensing systems, it is necessary to use very high and focused electromagnetic fields in order to reach the temperatures required for the release of mercury, which results in high equipment costs and requires a remarkable precision. Moreover, when a lamp also contains shielding members, whose surface is very wide and usually of the order of about 250 $mm^2$, also these shielding members are subject to heating during the activation process by the electromagnetic induction, causing the release of gases that are harmful for the operation of the lamp. This phenomenon, generally known as "outgassing", reduces the sorption capacity of the getter material contained in the dispensing system, thus resulting in a reduction of its working life and, as a consequence, of the lamp.

Mercury dispensing systems for fluorescent lamps are described e.g. in the U.S. Pat. No. 6,043,603, wherein the mercury releasing compound and the getter material are present in form of powders deposited on a sheet metal plate acting as support and are arranged according to a strip pattern. The use of a sheet metal plate as a support for the mercury releasing compound allows to increase the effectiveness of the activation process by setting up a target for the electromagnetic field having a much larger size than the powders of the mercury releasing compound. However, an arrangement of the mercury releasing compound and getter material in the form of strips on a flat support may cause the detachment of the particles from the support, resulting in the risk of blackenings and damaging the lamp.

The international patent publication WO 98/53479 in the applicant's name describes filiform mercury dispensing members containing powders of a compound able to release mercury and powders of getter material. The use of filiform members in mercury dispensing systems is extremely advantageous because it allows to precisely dose the mercury (better than a strip) and minimizes the risk of detachment of particles which would damage the lamp or would compromise its operation. However, the filiform members have a very small size, which requires the use of very high electromagnetic fields and leads to focalization problems during the activation step of the material, as described above. In the case in which the filiform members are fixed on shielding members, the activation process causes the heating of the shielding members and thus the outgassing phenomenon, with the above-discussed consequences of reduction of the sorption capacity of the getter material.

It is therefore an object of the present invention to provide a mercury dispensing system for fluorescent lamps, which can overcome the disadvantages present in the state of the art, and in particular allowing to increase the effectiveness of the activation process of the mercury releasing compound without causing outgassing problems or jeopardizing the sorption capacity of the getter material. Said object is achieved by means of a mercury dispensing system, whose main features are disclosed in claim 1 and other features are disclosed in the dependent claims.

The mercury dispensing system according to the present invention comprises a mercury dispensing member fixed on a suitable support. As a consequence of the optimized size of the surface area of the support, the mercury dispensing system of the present invention allows to obtain a simple and effective activation of the mercury releasing compound while minimizing at the same time the outgassing phenomenon.

Moreover, the arrangement of the filiform member with respect to the support may be so chosen to form a closed loop. By suitably orienting the loop with respect to the electromagnetic field it is possible to induce a flow of electric current in the dispensing system, which helps its heating process and thus its activation.

Another advantage offered by the invention is that the arrangement of the dispensing system is optimized both respect to the filaments of the cathodes and to possible shielding members, thus helping to minimize their outgassing and the related problems that can reduce performance and life of the lamp.

Further advantages and features of the mercury dispensing system according to the present invention will be able to become clear for those skilled in the art from the following detailed and non-limiting description of the possible embodiments of the invention and with reference to the attached drawings, wherein.

In order to improve the understanding of the drawings, dimensions and size ratios of the constituting members shown are not in scale. Moreover, details of the possible dispensing systems being not strictly necessary for carrying out the invention have not been shown. For example, the filiform members of FIGS. 1 and 2 have been shown as provided with longitudinal slits, but it should be pointed out that either filiform members provided with slits or filiform members having apertures only at their ends can indifferently be used according to the invention.

Figure 1:
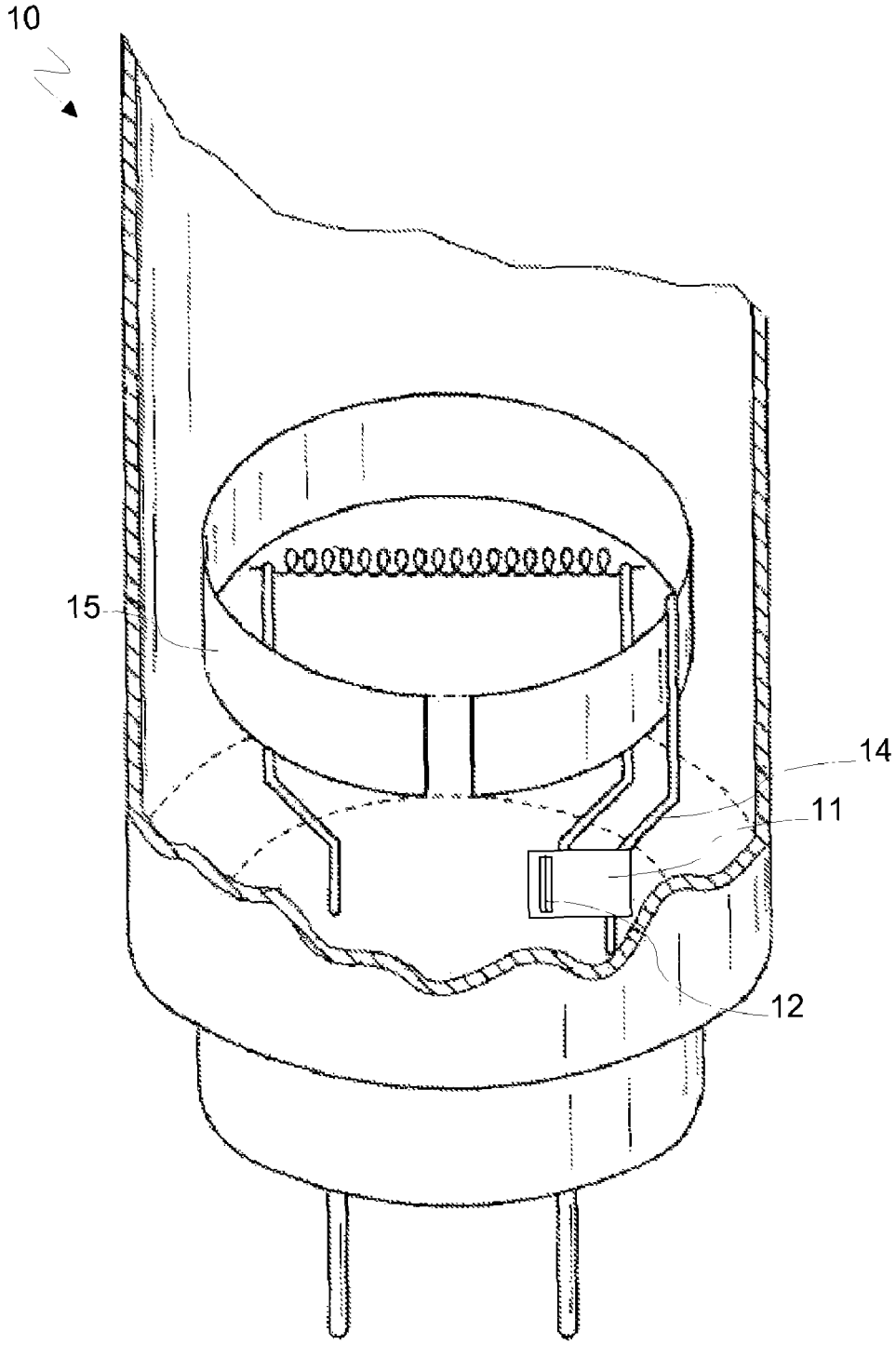
FIG. 1 is a perspective, partially broken view of a fluorescent lamp comprising a first embodiment of the mercury dispensing system according to the present invention.

FIG. 1 shows a partially broken view of a fluorescent lamp 10 comprising a mercury dispensing system 11 according to the present invention. The dispensing system 11 comprises a dispensing member 12 mounted on a support 13. The dispensing member 12 is preferably a filiform member as described in the international publication WO 98/53479. The filiform element is characterized by a ratio between length and maximum transverse width of at least 2:1. The typical length of the filiform member 12 is comprised between 2 and 7 mm, while the size in the transverse direction is typically comprised between 0.5 and 1.5 mm. The cross-section of the filiform member is preferably trapezoid-shaped, but other geometries, such as square or circular, may be used as well. Moreover, the filiform member 12 is preferably provided with a longitudinal slit suitable to help a controlled release of mercury vapors from the compound. The filiform member 12 advantageously further comprises a getter material, e.g. a Zr—Al alloy containing the 16% by weight of Al, as described in U.S. Pat. No. 3,203,901 or a Zr—Co-MM alloy, wherein MM indicates Y, La, Ce, Pr, Nd, rare earths metals or mixtures of these elements, comprising about 80% by weight of Zr, 15% of Co and the remaining of MM. In this case both the mercury releasing compound and the getter material are present in the filiform member in the form of powders, mutually mixed and generally having a particle size preferably lower than 125 μm.

As shown in the drawing, a shielding member 15 suitable to block the cathode material vaporized during the operation of the lamp is fixed to the third electrode 14. The support 13 is fixed, e.g. by welding or by mechanical crimping, to the third electrode of the lamp 14. In alternative, the support can be fixed to one of the lead-wires of the lamp (the metallic wires holding the filament), rather than to the third electrode.

Figure 2:
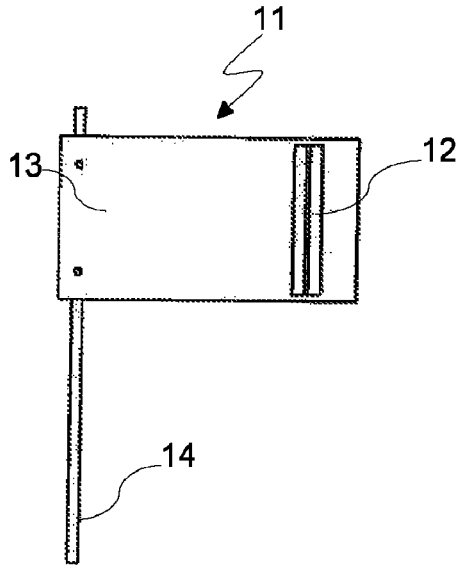
FIG. 2 is a detailed view of the dispensing system shown in FIG. 1.

As shown in the detail of FIG. 2, in a first embodiment of the invention the support 13 is in the form of a sheet metal plate.

As it is known from U.S. Pat. No. 6,043,603, the use of a sheet metal plate as a support for the mercury dispensing member allows to increase the effectiveness of the activation process of the mercury releasing compound by providing a target with a larger size than the dispensing member 12, allowing a better coupling between the electromagnetic field and the dispensing system.

However, as a result of many tests, the inventors have found out that, although a wide surface area of the support 13 allows to increase the effectiveness of the activation process, this causes outgassing of the support 13 and results in negative consequences similar to those above discussed. Therefore, it is necessary to design the support 13 in order to meet the requirement of an effective activation process but at the same time to ensure a limited impurities outgassing of the support 13. According to the present invention, the size of the support 13 must be comprised between 9 and 64 $mm^2$. In fact, in the lamp field, it is preferable the use of a dispensing system that guarantees an outgassing value lower than 10 $cm^3$ mbar. Using a support with a surface area greater than 64 $mm^2$, the inventors have found that the outgassing from the dispensing system is higher than the above referred upper limit value. In a preferred embodiment of the invention, the surface area for the metal sheet supporting the mercury dispensing member is comprised between 20 and 50 $mm^2$.

Still referring to the detail of FIG. 2, the sheet metal plate 13 has a rectangular shape, in which the short side has a size slightly larger than the longitudinal size of the filiform member 12. The filiform member 12 is fixed, by welding on a face of the sheet metal plate 13 proximate to one of its edges. When the fixing is carried out by welding, it might be preferable to space apart the filiform member 12 from the welding area in order to avoid the risk of an undesired activation of the mercury releasing compound or of contaminations of the lamp during the intermediate step of welding in the manufacturing process.

In order to avoid that the shielding member 15 is inside the electromagnetic field during the activation step of the mercury releasing compound, the center of gravity of the support 13 must be spaced by at least 5 mm from the closest edge of the shielding member 15.

Figure 3:
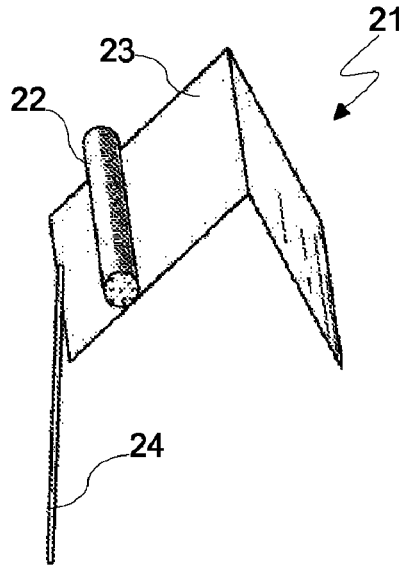
FIG. 3 shows a second embodiment of the dispensing system of the present invention.

FIG. 3 shows a second embodiment of the dispensing system of the present invention. The dispensing system 21 comprises a filiform member 22 fixed on a support 23 still in the form of a sheet metal plate in turn fixed on an upright 24. Differently from the sheet metal plate 13 of FIG. 2, the sheet metal plate 23 has at least one fold in the transverse direction. Alternatively, a bent portion may be provided. The embodiment having a folded or bent sheet metal plate is particularly advantageous in small diameter lamps, wherein the dispensing system may also serve as a shielding member.

Suitable materials for manufacturing the support 13, 23 of the filiform member 12, 22 are for instance steel, nickel and nickel plated iron, which are metals typically used in the manufacturing of filiform dispensing members.

Figure 4:
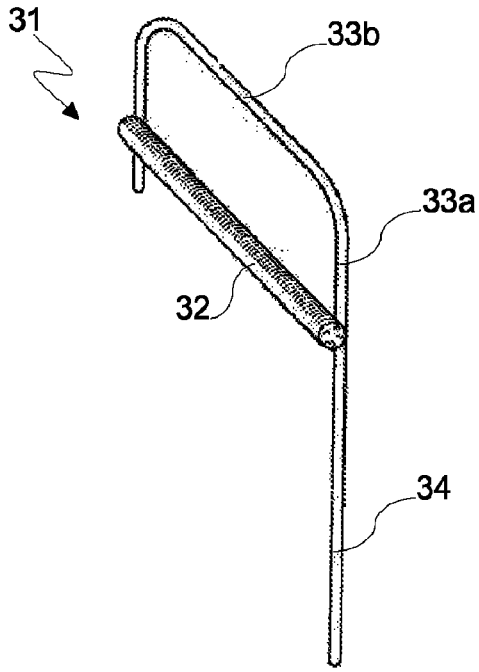
FIG. 4 shows a third embodiment of the mercury dispensing system according to the present invention.

FIG. 4 shows a third embodiment of a dispensing system according to the present invention. The dispensing system 31 comprises a filiform member 32 mounted on a support 33, preferably cylindrical, having a small cross-section and comprising a first straight portion 33*a* and a second bent portion 33*b*. The support 33 is fixed on an upright 34. The wording "support having a small cross-section" indicates a support having a transverse dimension lower than 2 mm.

The filiform member 32 is fixed between the free end of the second bent portion and the first straight portion, thus forming a closed loop therewith. This embodiment has the advantage that by suitably orienting the closed loop formed by the filiform member 32 and the support 33 with respect to the electromagnetic field during the activation process, it is possible to induce a flow of electric current. As a consequence of this aspect it is possible to obtain an effective heating of the filiform member 32 for the activation of the mercury releasing compound by using a support 33 having a smaller size than the sheet metal plate embodiment, with remarkable advantages in terms of the total size of the dispensing system. The inventors have found out that by using a closed-loop configuration between the support and the dispensing member, the suitable surface contained in the closed-loop support to ensure an effective activation process and to avoid outgassing problems is comprised between 9 and 35 $mm^2$.

Figure 5:
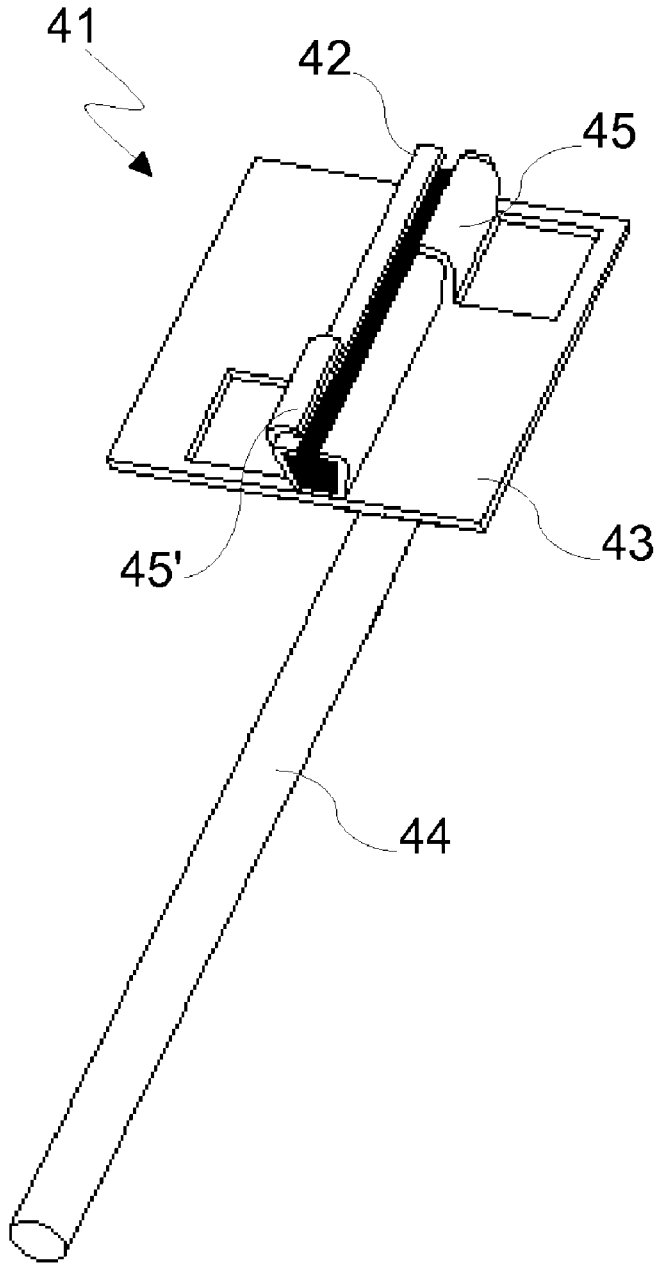
FIG. 5 shows a fourth embodiment of the mercury dispensing system according to the present invention.

In FIG. 5 is shown, as alternative embodiment of the invention, a dispensing system 41 wherein the filiform dispensing element is fixed on the metal plate support 43 by one or more mechanical fixing means (45, 45').

It is clear that the above-illustrated embodiments of the invention are only examples susceptible of numerous variants. For example, the folded sheet metal plate support might be used in a closed loop embodiment, in which the filiform member is fixed between opposite edges of the sheet metal plate. The invention will be further described with reference to the following examples.

Example 1

A mercury dispensing system according to the present invention has been obtained fixing a filiform dispensing element (length about 5 mm, and a trapezoidal cross-section having a maximum transversal width about 1 mm and height about 0.8 mm) on a metal substrate having an area of 25 $mm^2$ (5 mm long and 5 mm wide) In vacuum conditions (pressure lower than $10^{-4}$ mbar), the dispensing system has been heated up to 750° C. or 900° C. by an induction coil with a diameter of 40 mm, coil connected to an RF power source with a nominal power of 5 KW. The mercury dispensing system, during the experiment, has been perpendicularly coupled to the electro-magnetic field. In tables 1 and 2 the impurities outgassing (measured by a pressure gauge) and the power needed to obtain the desired temperature have been reported.

Example 2

A mercury dispensing system according to the present invention has been obtained fixing a filiform dispensing element as in the Example 1 has been fixed on a metal substrate having an area of 54 $mm^2$ (6 mm long and 9 mm wide) and has been evaluated in the same experimental conditions. In tables 1 and 2 the impurities outgassing and the power needed to obtain the desired temperature have been reported.

Example 3 (Comparative)

A mercury dispensing system has been obtained fixing a filiform dispensing element as in the Example 1 has been fixed on a metal substrate having an area of 72 $mm^2$ (8 mm long and 9 mm wide) and has been evaluated in the same experimental conditions. In tables 1 and 2 the outgassing and the power needed to obtain the desired temperature have been reported.

Example 4 (Comparative)

A filiform dispensing element as in the Example 1 but without fixing it on a metal substrate has been evaluated in the same experimental conditions described in the previous examples. In tables 1 and 2 the outgassing and the power needed to obtain the desired temperature have been reported.

TABLE 1

| Heating at 750° C. | | | | |
|---|---|---|---|---|
| Substrate | no substrate | 25 $mm^2$ | 54 $mm^2$ | 75 $mm^2$ |
| RF Power (%) | 100% | 57% | 41% | 36% |
| Outgassing ($cm^3$ mbar) | 1.4 | 2.1 | 7.0 | 10.8 |

TABLE 2

| Heating at 900° C. | | | | |
|---|---|---|---|---|
| Samples: | no substrate | 25 $mm^2$ | 54 $mm^2$ | 75 $mm^2$ |
| RF Power (%) | n.a. | 73% | 57% | 45% |
| Outgassing ($cm^3$ mbar) | n.a. | 3.4 | 9.6 | 13.8 |

The invention clamed is:

1. A mercury dispensing system for fluorescent lamps comprising a dispensing member containing a compound suitable for releasing mercury, said dispensing member being fixed on a metal support suitable for being heated by electromagnetic induction in order to activate said mercury releasing compound, wherein the dispensing member is filiform and a surface area of the support suitable for being exposed to an electromagnetic field is comprised between 9 and 64 $mm^2$.

2. The dispensing system according to claim 1, wherein the metal support is in the form of a sheet metal plate.

3. The dispensing system according to claim 2, wherein the surface area of the sheet metal plate is comprised between 20 and 50 $mm^2$.

4. The dispensing system according to claim 3, wherein the sheet metal plate is provided with at least one bend in a transverse direction.

5. The dispensing system according to claim 3, wherein the dispensing member is fixed on a face of the sheet metal plate.

6. The dispensing system according to claim 4, wherein the dispensing member is fixed between opposite edges of the sheet metal plate.

7. The dispensing system according to claim 1, wherein the metal support comprises a first straight portion and a second bent portion, the dispensing member being between a free end of the second bent portion and the first straight portion and forming a closed loop therewith.

8. The dispensing system according to claim 7, wherein the surface area of the metal support suitable for being exposed to the electromagnetic field is comprised between 9 and 35 $mm^2$.

9. The dispensing system according to claim 1, further comprising a shielding member suitable for blocking a cathode material vaporized during lamp operation.

10. The dispensing system according to claim 1, wherein the mercury releasing compound comprises $Ti_xZr_yHg_z$, x and y ranging between 0 and 13 and z being equal to 1 or 2, the sum of x and y being comprised between 3 and 13.

11. The dispensing system according to claim 10, wherein the mercury releasing compound contains a $Ti_3Hg$ phase.

12. The dispensing system according to claim 10, wherein the mercury releasing compound also comprises a mercury release promoter compound.

13. The dispensing system according to claim 12, wherein the mercury release promoter compound comprises copper with at least one second element chosen among tin, indium and silver.

14. The dispensing system according to claim 12, wherein the mercury release promoter compound comprises copper and silicon.

15. The dispensing system according to claim 12, wherein the mercury release promoter compound comprises copper, tin and rare earths.

16. The dispensing system according to claim 1, wherein the mercury releasing compound comprises titanium-copper-mercury ternary compounds.

17. The dispensing system according to claim 1, wherein the mercury releasing compound comprises a quaternary mercury releasing compound having a weight percentage of titanium comprised between 10 and 42%, copper comprised between 14 and 50%, mercury comprised between 20 and 50% and a weight percentage comprised between 1 and 20% of one or more elements among tin, chromium and silicon.

18. The dispensing system according to claim 10, wherein the mercury releasing compound further comprises a getter material.

19. A fluorescent lamp comprising the mercury dispensing system according to claim 1.

* * * * *